US005904623A

United States Patent [19]

Chang

[11] Patent Number: 5,904,623

[45] Date of Patent: May 18, 1999

[54] APPARATUS FOR FORMING A SLOT IN A SEMI-PRODUCT OF A BOLT PRIOR TO THREAD FORMATION

[76] Inventor: Chih-Feng Chang, 7F-2, No. 31, Kai-Hsuan Rd., Tainan, Taiwan

[21] Appl. No.: 09/097,777

[22] Filed: Jun. 15, 1998

[30] Foreign Application Priority Data

Mar. 17, 1998 [TW] Taiwan ..... 87103915

[51] Int. Cl.[6] ..... B21H 3/02

[52] U.S. Cl. ..... 470/63; 470/57; 72/356; 72/359

[58] Field of Search ..... 470/8, 9, 11, 12, 470/16, 57, 58, 60, 63, 148, 149, 139, 156, 161, 191; 72/356, 358, 359

[56] References Cited

U.S. PATENT DOCUMENTS

| | | | |
|---|---|---|---|
| 2,996,093 | 8/1961 | Moore | 470/9 |
| 3,188,849 | 6/1965 | Wisebaker et al. | 470/11 |
| 4,485,510 | 12/1984 | Hatter | 470/9 |
| 4,805,437 | 2/1989 | Heil, Jr. et al. | 72/359 |
| 4,932,234 | 6/1990 | Adachi | 72/356 |
| 5,667,443 | 9/1997 | Allen | 470/12 |

*Primary Examiner*—Joseph J. Hail, III
*Assistant Examiner*—Ed Tolan
*Attorney, Agent, or Firm*—Rodman & Rodman

[57] ABSTRACT

An apparatus for forming a slot in a semi-product of a bolt prior to thread formation includes a punch and a die mechanism. The die mechanism includes a tubular member, and an elongated die member formed integrally with a slot-forming plate which is located at a front end portion thereof and which has a uniform-thickness flat middle portion and two side portions that are wider than the middle portion. The semi-product can be compressed between the punch and the slot-forming plate of the die member in a central bore in a high-hardness block, which is fixed in the tubular member, to form the slot. Accordingly, the slot has a uniform-width middle portion and two end portions which are wider than the uniform-width middle portion. When threads are formed on the semi-product by means of a lathe, no projections are created in the uniform-width middle portion of the slot, thereby permitting a wedge-shaped end of a screwdriver to engage fittingly the uniform-width middle portion of the slot.

6 Claims, 8 Drawing Sheets

APPARATUS FOR FORMING A SLOT IN A SEMI-PRODUCT OF A BOLT PRIOR TO THREAD FORMATION

BACKGROUND OF THE INVENTION

1. Field of the Invention

This invention relates to a method for making a slotted bolt, more particularly to an apparatus for forming a slot in an end surface of a semi-product of a bolt prior to thread formation.

2. Description of the Related Art

Referring to FIG. 1, in a case where threads of a set bolt 1 are formed prior to formation of a slot 10 (shown in slotted lines) in an upper end surface of the bolt 1 by a lathe in a known manner, several tabs 11 (only one is shown) may be created on the bolt 1 at positions adjacent to two end portions of the slot 10. In this case, it is necessary for the bolt 1 to undergo vibration processing in order to have the tabs 11 drop therefrom. To enable removal of the tabs 11 from the bolt 1 by vibration, the bolt 1 is made of high speed steel, thereby resulting in increased manufacturing costs. Because the slot 10 is formed by means of a lathe, the production efficiency is reduced, and a large amount of metal waste is created.

Referring to FIG. 2, in a case where a slot 10' is formed in an upper end surface of a bolt 1' prior to formation of threads by a lathe in a known manner, several sharp projections 12 may be formed on the bolt 1' in two end portions of the slot 10', thereby obstructing insertion of a wedge-shaped end of a screwdriver into the slot 10'. As a result, this slot forming process is seldom adopted by manufacturers of slotted-bolts.

SUMMARY OF THE INVENTION

The object of this invention is to provide an apparatus for forming rapidly a slot in a semi-product of a bolt prior to thread formation by forging so as to reduce the manufacturing costs of the bolt and so as to minimize creation of metal waste.

According to this invention, an apparatus for forming a slot in a semi-product of a bolt prior to thread formation includes a punch and a die mechanism. The die mechanism includes a tubular member, and an elongated die member formed integrally with a slot-forming plate which is located at a front end portion thereof and which has a uniform-thickness flat middle portion and two side portions that are wider than the middle portion. The semi-product can be compressed between the punch and the slot-forming plate of the die member in a central bore in a high-hardness block which is fixed in the tubular member, to form the slot. Accordingly, the slot has a uniform-width middle portion and two end portions which are wider than the uniform-width middle portion. When threads are formed on the semi-product by means of a lathe, no projections are created in the uniform-width middle portion of the slot, thereby permitting a wedge-shaped end of a screwdriver to engage fittingly the uniform-width middle portion of the slot.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 3:
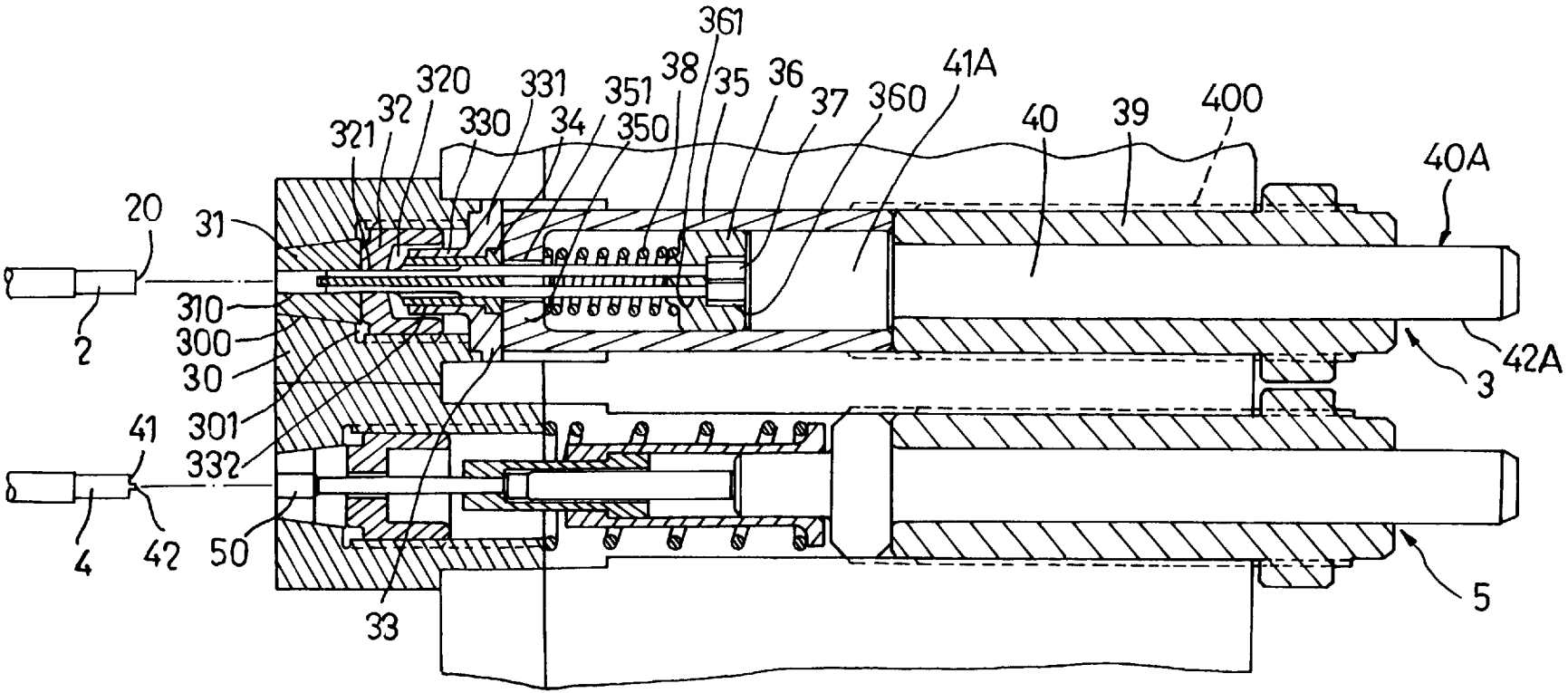
FIG. 3 illustrates the preferred embodiment of an apparatus for forming a slot in an end surface of a semi-product of a bolt prior to thread formation according to this invention.

Referring to FIG. 3, the preferred embodiment of an apparatus for forming a slot in an end surface of a bolt prior to thread formation includes a slot forming device and a flattening device. The slot forming device consists of a punch 2 and a die mechanism 3. The flattening device consists of a punch unit 4 and a die unit 5. The punch 2 and the punch unit 4 are mounted respectively relative to the die mechanism 3 and the die unit 5 in a known manner. The punch 2 has a flat pressing surface 20. The punch unit 4 has an end surface 41 formed with a rib 42. The die unit 5 has a cylindrical cavity 50 formed in a surface thereof.

The die mechanism 3 includes a generally circular tubular member 30, a truncated conical high-hardness block 31, a nut 32, a sleeve 33, an elongated die member 34, a hollow horizontal cylinder 35, a pushing block 36, two parallel ejector rods 37, a coiled compression spring 38, a hollow adjustment bolt 39, a die bed 40 and a push rod 40A.

The circular tubular member 30 is fixed on the die bed 40 in a known manner, and has a front end surface with a truncated conical chamber 300 formed therein, and a rear end surface with a threaded chamber 301 which is formed therein and which is communicated with the conical chamber 300. The punch 2 is movable relative to the tubular member 30. The truncated conical chamber 300 has an outer end and an inner end which is larger than the outer end but smaller than the threaded chamber 301 in diameter.

The truncated conical high-hardness block 31 is made of tungsten carbide, and is received fittingly within the truncated conical chamber 300 in the generally circular tubular member 30. A central bore 310 is formed through the block 31.

The nut 32 engages threadably the threaded chamber 301 in the tubular member 30 to contact a rear end surface of the block 31, thereby fixing the block 31 in the circular tubular member 30. A central counterbore is formed through the nut 32 in alignment with the central bore 310 in the block 31, and has a large-diameter rear portion 320 and a small-diameter front portion 321 which is approximate to the central bore 310 in the block 31 in diameter and smaller than the large-diameter rear portion 320 in diameter.

The sleeve 33 has a front portion 330 positioned within the large-diameter rear portion 320 of the central counterbore in the nut 32, a rear flange portion 331 which is larger than the front portion 320 in diameter and which abuts against the rear end surface of the tubular member 30, and a central counterbore 332 which is formed through the sleeve 33 and which has a small-diameter front portion and a large-diameter rear portion that is larger than the front portion of the central counterbore 332 in the sleeve 33.

Figure 4:
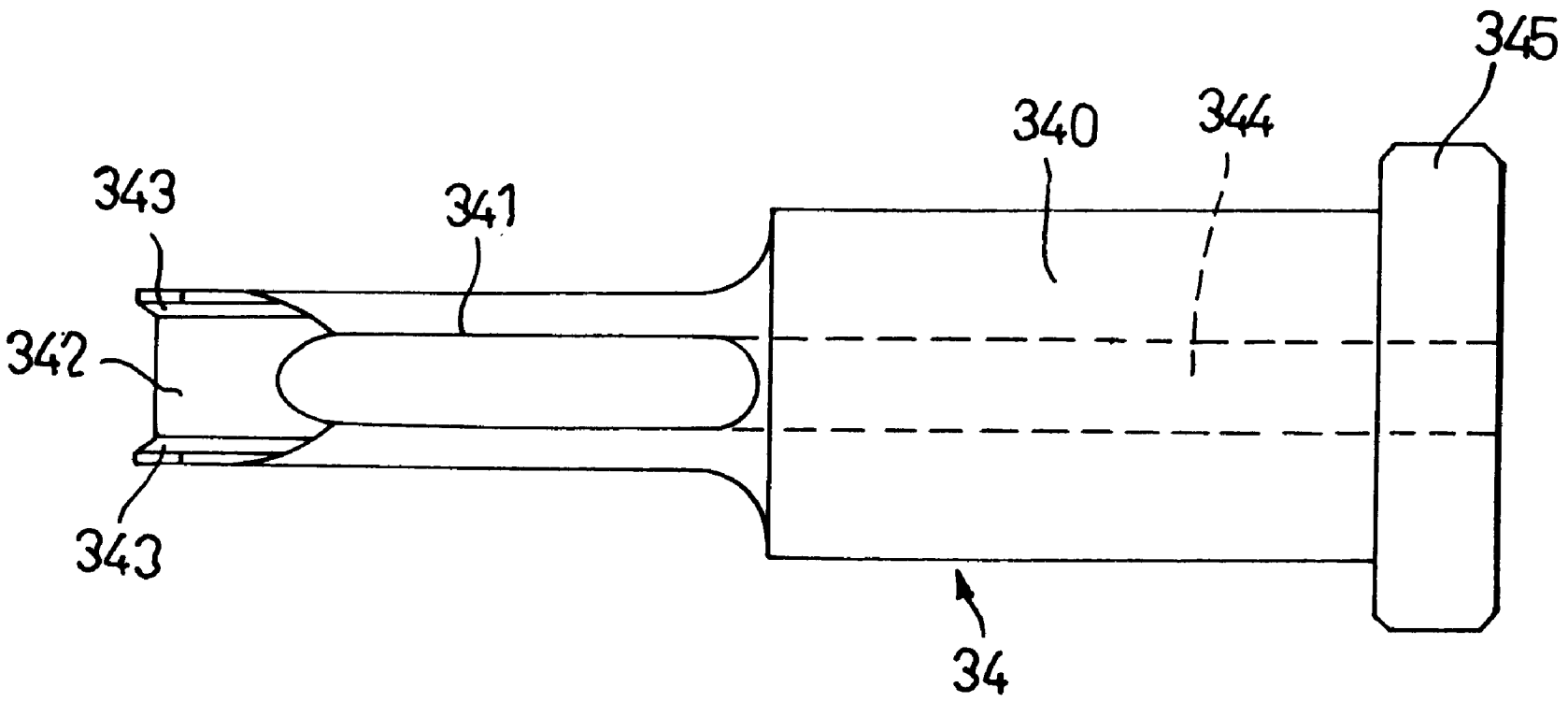
FIG. 4 illustrates an elongated die member of the preferred embodiment.
Figure 4A:
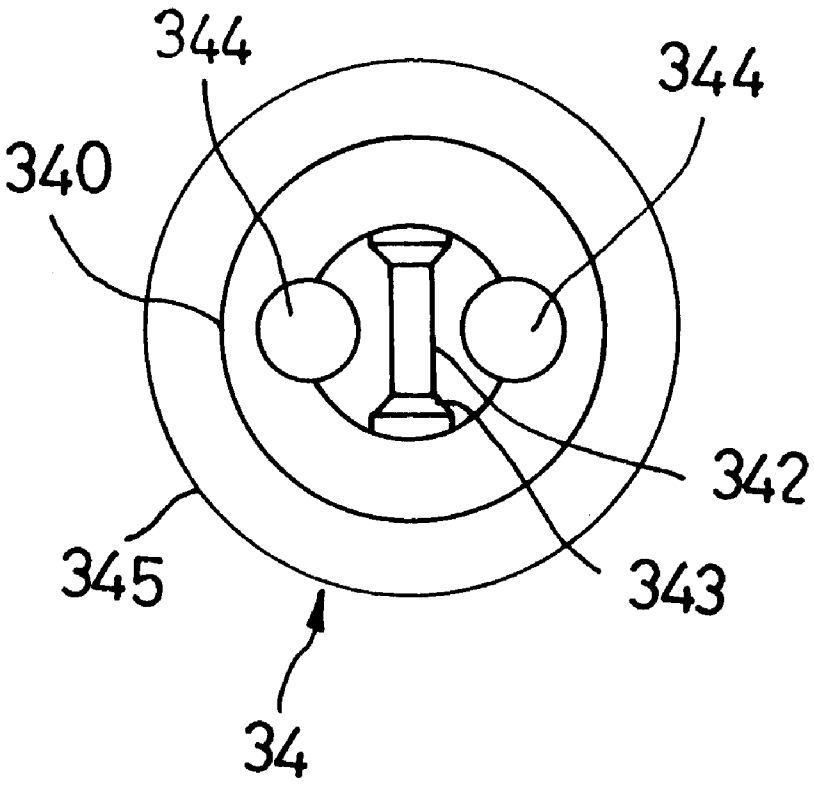
FIG. 4A is an end view illustrating how two axial holes are located relative to a slot-forming plate of the preferred embodiment.
Figure 5:
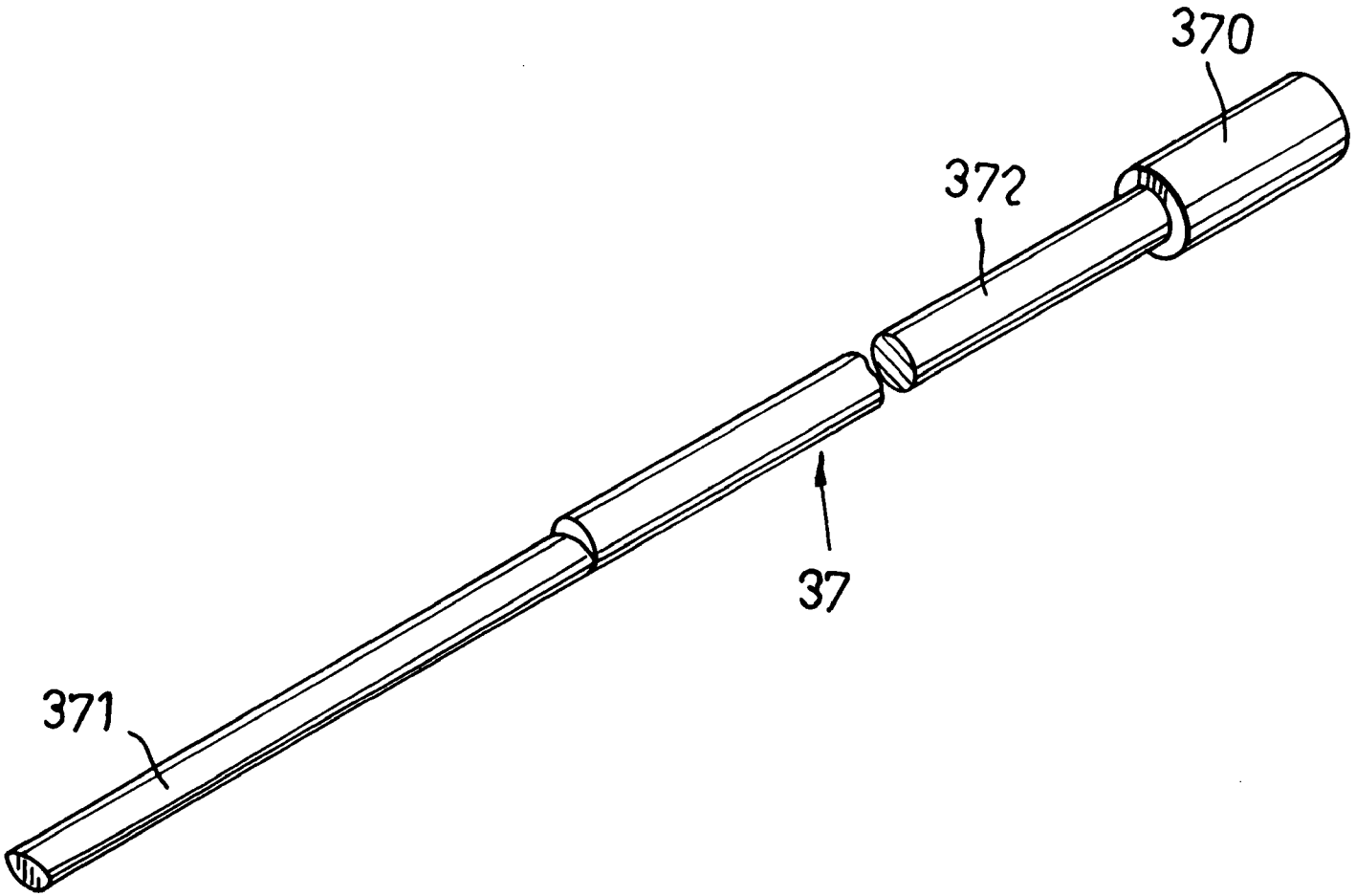
FIG. 5 is a perspective view of an ejector rod of the preferred embodiment.

Referring to FIGS. 3, 4 and 4A, the elongated die member 34 has a generally cylindrical rear portion 340 and a slot-forming plate 341, which is disposed at a front end portion of the die member 34 and which is formed integrally with the rear portion 340. The generally cylindrical rear portion 340 has two axial holes 344, which are formed therethrough and which located on two sides of the slot-forming plate 341. The slot-forming plate 341 extends from the nut 32 into the central bore 310 of the block 31, and has a uniform-thickness flat middle portion 342 and two side portions 343, which are wider than the middle portion 342 so as to be adapted to compress the semi-product between the flat pressing surface 20 of the punch 2 and the slot-forming plate 341 of the die member 34 in the central bore 310 in the block 31, thereby forming the slot in the semi-product 61 (see FIG. 6) to constitute a slotted member 62 (see FIG. 6).

Figure 6:
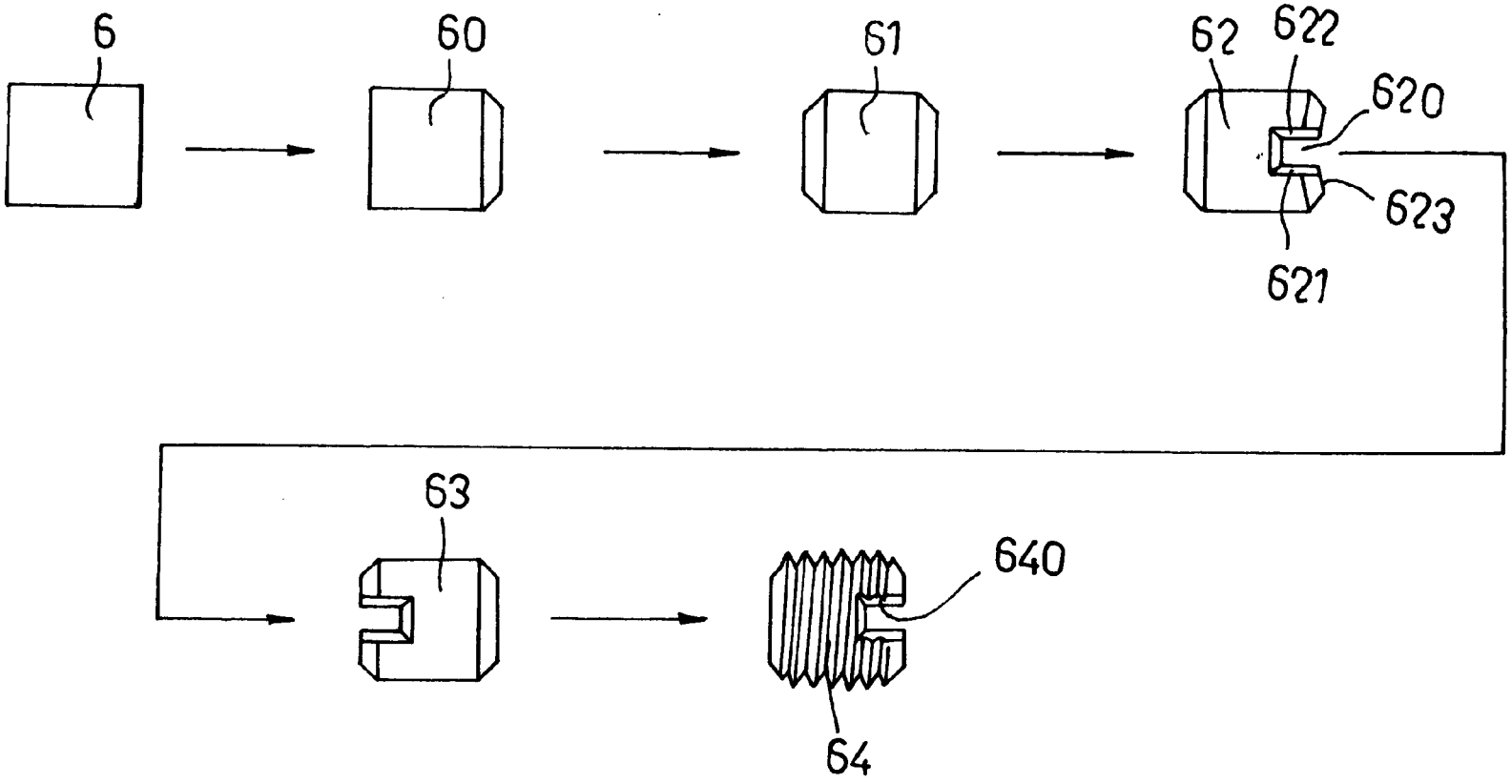
FIG. 6 is a flow chart illustrating a process for forming a slotted bolt in which a slot is formed by the preferred embodiment of this invention.

Referring to FIG. 6, the slotted member 62 is formed with a slot 620 which has a uniform-width middle portion 621 and two end portions 622 that are wider than the middle portion 621. As illustrated, the end surface of the slotted member 62 is inclined relative to the axis of the slotted member 62.

Again referring to FIGS. 3, 4 and 4A, the horizontal cylinder 35 abuts against the sleeve 33 so that the adjustment bolt 39 presses the horizontal cylinder 35 and the sleeve 33 against the tubular member 30. The die member 34 has an outwardly extending flange 345 at a rear end thereof, and is received fittingly within the central counterbore 332 of the sleeve 33 in such a manner that the flange 345 is located within the large-diameter rear portion of the central counterbore 332 in the sleeve 33, thereby fixing the die member 34 relative to the die bed 40.

The horizontal cylinder 35 has a vertical front wall 350, which abuts against the sleeve 33 and the die member 34 to clamp the sleeve 33 between the tubular member 30 and the horizontal cylinder 35. The front wall 350 has two holes 351 through which the ejector rods 37 extend respectively.

The pushing block 36 has a rear end surface formed with two counterbores 360. As illustrated, each of counterbores 360 is formed through the pushing block 36, and has a small-diameter front portion and a large-diameter rear portion, which opens to the rear end surface of the pushing block 36.

The ejector rods 37 extend through the counterbores 360 in the pushing block 36, the compression spring 38, and the holes 351 in the horizontal cylinder 35, and into the central bore 310 in the block 31. As illustrated in FIG. 3, the front ends of the ejector rods 37 are located at non-ejecting positions which are somewhat behind the front end of the die member 34. Each of the ejector rods 37 has an enlarged rear end portion 370, a thin front end portion 371 and an intermediate portion 372, which has a circular cross-section. The enlarged rear end portion 370 is larger than the small-diameter front portions of the counterbores 360 in the pushing block 36 but smaller than the large-diameter rear portions of the counterbores 360 in the pushing block 36 in diameter.

The coiled compression spring 38 is sleeved on the ejector rods 37 between the pushing block 36 and the front wall 350 of the horizontal cylinder 35.

The adjustment bolt 39 is mounted within a threaded hole 400 in the die bed 40.

The push rod 40A has a large-diameter front portion 41A which is clamped between the pushing block 36 and the adjustment bolt 39, and a small-diameter rear portion 42A, which extends through a central bore in the adjustment bolt 39. After the slot 620 is formed in the slotted member 62, the push rod 40A can be pushed forward to move the ejector rods 37 relative to the die member 34 against the biasing force of the spring 38 until the front ends of the ejector rods 37 are in front of the front end of the die member 34.

Figure 8:
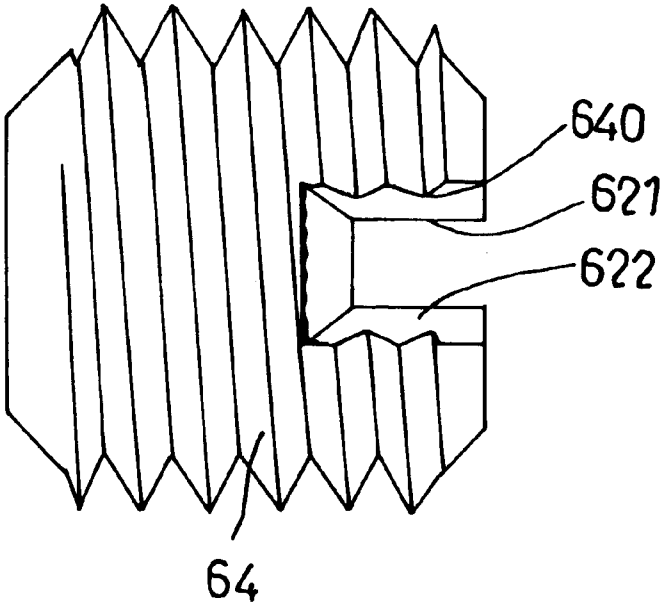
FIG. 8 is a perspective view showing the resulting product of the bolt which is formed from the semi-product of FIG. 7 and which is threaded by means of a lathe.
Figure 7:
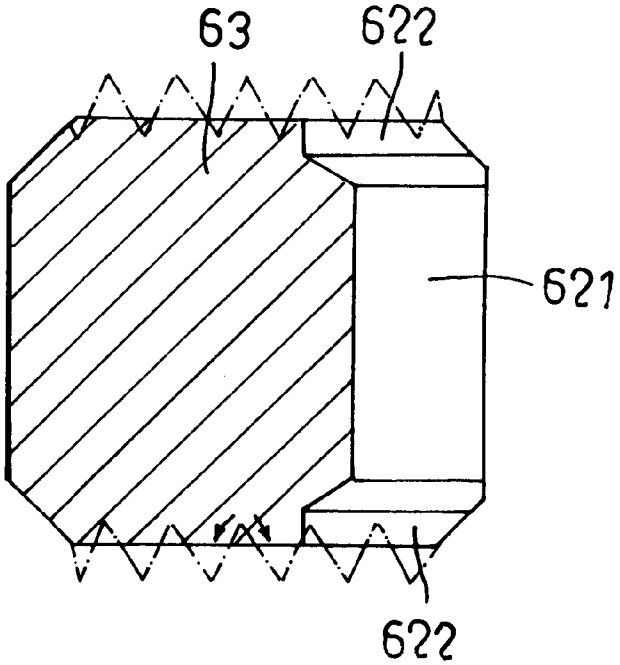
FIG. 7 illustrates a semi-product of a bolt which has been processed by the preferred embodiment of this invention.
Figure 8A:
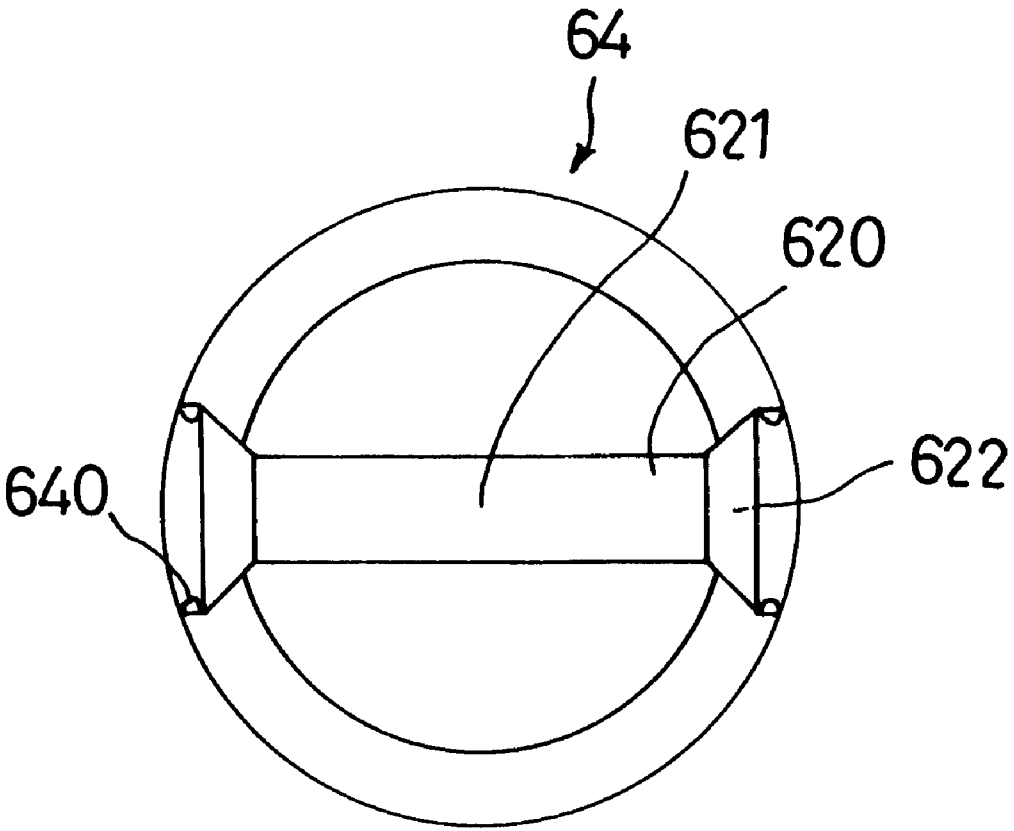
FIG. 8A is an end view of the resulting product of FIG. 8.

Referring to FIG. 6, to form the semi-product 61, a cylindrical blank 6 is placed into the cavity 50 (see FIG. 3) in the die unit 5 (see FIG. 3) . Then, a specific punch (not shown) is operated to impact the blank 6 and form a forged member 60 which is then forged into the semi-product 61. After the semi-product 61 is forged into the slotted member 61 by means of the slot forming device which consists of the punch 2 (see FIG. 3) and the die mechanism 3 (see FIG. 3), the slotted member 61 is moved mechanically into the cavity 50 (see FIG. 3 ) in the die unit 5 (see FIG. 3) . Then, the punch unit 4 (see FIG. 3) is operated to move the rib 42 (see FIG. 3) into the slot 620 in the slotted member 62 so as to flatten the surface 623 and a wall of the slotted member 62 defining the slot 620, thereby forming a flattened member 63 (see FIGS. 6 and 7) . The flattened member 63 is machined by means of a lathe to form a bolt 64 (see FIGS. 6 and 8) with several projections 640 along the threads. Because the projections 640 are formed in the end portions 622 of the slot 620, a wedge-shaped end of a screwdriver (not shown) is unlikely to contact the projections 640 when the former is inserted into the slot 620.

Figure 2:
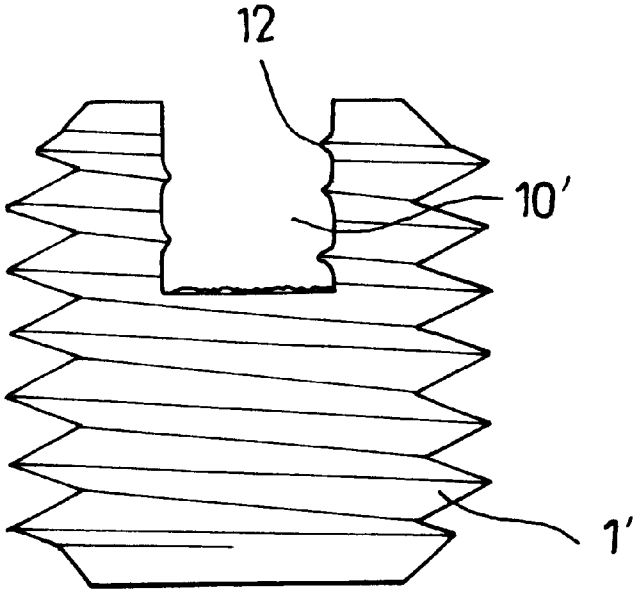
FIG.2 PRIOR ART
FIG. 2 is a perspective view illustrating how several projections may be formed on a semi-product of a bolt in which a slot is formed prior to thread formation in a know manner.
Figure 1:
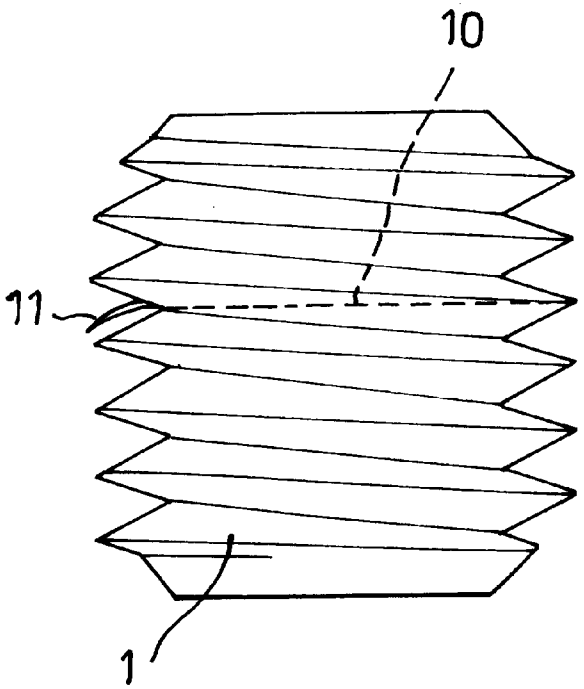
FIG.1 PRIOR ART
FIG. 1 is a perspective view illustrating how a tab may be created on a semi-product of a bolt in which a slot is formed after thread formation in a known manner.

The apparatus of this invention has the following advantages:

(1) Because the semi-product 61 is forged into the slotted member 62, no tab 11 (see FIG. 1) is likely to be formed on the slotted member 62 or the flattened member 63. Accordingly, the semi-product 61 can be made of carbon steel which is cheaper than high speed steel that is the material commonly used for the prior art bolt shown in FIG. 1, thereby decreasing the manufacturing costs of the slotted bolt.

(2) In a situation where a slot is formed in an end surface of a semi-product of a bolt by a lathe in a known manner, the production rate of the bolts is about 20~40 pieces per minute. By using the apparatus of this invention, the production rate of the slotted bolts can be increased up to 200~250 pieces per minute.

(3) Because the semi-product 61 is forged into the slotted member 62, no metal waste is likely to be created, thereby further reducing the manufacturing costs of the slotted bolt.

With this invention thus explained, it is apparent that numerous modifications and variations can be made without departing from the spirit and scope of this invention. It is therefore intended that this invention be limited as indicated only in the appended claims.

I claim:

1. An apparatus for forming a slot in a semi-product of a bolt prior to thread formation, said apparatus comprising a punch and a die mechanism which includes:

a generally circular tubular member having a front end surface with a truncated conical chamber formed therein, and a rear end surface with a threaded chamber which is formed therein and which is communicated with said conical chamber, said punch being movable relative to said tubular member, said truncated conical chamber having an outer end and an inner end which is larger than said outer end and smaller than said threaded chamber in diameter;

a truncated conical high-hardness block received fittingly within said truncated conical chamber in said generally circular tubular member and having a rear end surface and a central bore which is formed through said block;

a nut engaged threadably within said threaded chamber to contact said rear end surface of said block, thereby fixing said block in said generally circular tubular member, said nut having a central counterbore which is formed therethrough and which is aligned with said central bore in said block, said central counterbore in said nut having a small-diameter front portion approximate to said central bore of said block in diameter, and a large-diameter rear portion larger than said front portion in diameter; and an elongated die member fixed within said central counterbore in said nut and having a slot-forming plate which is located at a front end portion of said die member and which extends from said nut into said central bore in said block, said slot-forming plate having a uniform-thickness flat middle portion and two side portions which are wider than said middle portion so as to be adapted to compress the semi-product between said punch and said slot-forming plate of said die member in said central bore in said block, thereby forming the slot in the semi-product to constitute a slotted member;

whereby, said slot has a uniform-width middle portion and two end portions which are wider than the middle portion of the slot.

2. An apparatus as claimed in claim 1, wherein said die member further has a generally cylindrical rear portion which is formed integrally with said slot-forming plate and which has two axial holes that are formed through said generally cylindrical rear portion and that are located on two sides of said slot-forming plate, said apparatus further including two ejector rods which are fixed respectively within said axial holes in said die member, each of said ejector rods having a front end which is located at a non-ejecting position that is somewhat behind a front end of said slot-forming plate of said die member, whereby, after the slot has been formed in the semi-product, the semi-product can be pushed out of said generally circular tubular member by means of said ejector rods.

3. An apparatus as claimed in claim 2, wherein said die mechanism further includes:

a die bed on which said tubular member is fixed;

a sleeve having:

a front portion positioned within said large-diameter rear portion of said central counterbore in said nut, a rear flange portion which is larger than said front portion of said sleeve in diameter and which abuts against said rear end surface of said tubular member, and a central counterbore formed through said sleeve and having a small-diameter front portion and a large-diameter rear portion which is larger than said front portion of said central counterbore in said sleeve, said die member having an outwardly extending flange at a rear end thereof, a portion of said die member being received fittingly within said central counterbore in said sleeve in such a manner that said flange is located within said large diameter rear portion of said central counterbore in said sleeve;

a hollow horizontal cylinder having a vertical front wall which abuts against said sleeve and said die member to clamp said sleeve between said tubular member and said horizontal cylinder and which has two holes formed through said front wall, thereby permitting extension of said ejector rods through said holes in said front wall;

an adjustment bolt disposed on said die bed and contacting a rear end of said horizontal cylinder to press said horizontal cylinder against said sleeve; and a biasing unit disposed in said horizontal cylinder for biasing said front ends of said ejector rods to the non-ejecting positions, said biasing unit being capable of being operated to permit forward movement of said front ends of said ejector rods to a position in front of said front end of said slot-forming plate of said die member, thereby permitting stripping of the semi-product from said slot-forming plate of said die member.

4. An apparatus as claimed in claim 3, wherein said biasing unit includes:

a pushing block secured to rear ends of said ejector rods; and a compression spring sleeved on said ejector rods between said front wall of said horizontal cylinder and said pushing block;

whereby, after the slot has been formed in the semi-product, said pushing block can be pushed forward against biasing force of said compression spring so as to move said front ends of said ejector rods forward relative to said die member, thereby permitting removal of the semi-product from said die member.

5. An apparatus as claimed in claim 4, wherein said horizontal cylinder is clamped between said sleeve and said adjustment bolt, said adjustment bolt having a central bore formed therethrough, said pushing block having a rear end surface formed with two counterbores, each of which is formed through said pushing block and each of which has a small-diameter front portion and a large-diameter rear portion that opens to said rear end surface of said pushing block, each of said ejector rods having an enlarged rear end portion which is larger than said small-diameter front portions of said counterbores in said pushing block and smaller than said large-diameter rear portion of said counterbores in said pushing block in diameter, said apparatus further including a push rod which has a large-diameter front portion that is clamped between said pushing block and said adjustment bolt, and a small-diameter rear portion that extends through said central bore in said adjustment bolt, whereby, said push rod can be pushed forward to move said ejector rods relative to said die member against the biasing force of said compression spring.

6. An apparatus as claimed in claim 1, further comprising a flattening device which includes:

a punch unit having an end surface formed with a rib which has a rectangular cross-section; and a die unit with a cylindrical cavity which is formed in a surface thereof and which can receive the slotted member therein so that said rib of said punch unit can move into the slot in the slotted member, thereby flattening the end surface and a wall of the slotted member which defines the slot.

* * * * *